US007916101B2

(12) United States Patent
Oyama

(10) Patent No.: US 7,916,101 B2
(45) Date of Patent: Mar. 29, 2011

(54) LED DRIVING APPARATUS AND METHOD OF CONTROLLING LUMINOUS POWER

(75) Inventor: Yoshiki Oyama, Kanagawa (JP)

(73) Assignee: Sony Corporation (JP)

( * ) Notice: Subject to any disclaimer, the term of this patent is extended or adjusted under 35 U.S.C. 154(b) by 1059 days.

(21) Appl. No.: 11/242,159

(22) Filed: Oct. 3, 2005

(65) Prior Publication Data

US 2006/0082538 A1 Apr. 20, 2006

(30) Foreign Application Priority Data

Oct. 8, 2004 (JP) ..... P2004-296148
Aug. 5, 2005 (JP) ..... P2005-227965

(51) Int. Cl.
*G09G 3/32* (2006.01)

(52) U.S. Cl. ..... 345/82; 345/84; 345/102; 345/204; 345/207; 345/691

(58) Field of Classification Search ..... 345/82, 345/212, 207, 204, 214, 211, 102, 63, 84, 345/691
See application file for complete search history.

(56) References Cited

U.S. PATENT DOCUMENTS

| | | | | |
|---|---|---|---|---|
| 6,628,249 | B1 * | 9/2003 | Kamikawa et al. | 345/44 |
| 2003/0117422 | A1 * | 6/2003 | Hiyama et al. | 345/690 |
| 2003/0214242 | A1 * | 11/2003 | Berg-johansen | 315/169.3 |
| 2004/0105283 | A1 * | 6/2004 | Schie et al. | 363/21.12 |

FOREIGN PATENT DOCUMENTS

| | | | |
|---|---|---|---|
| JP | 04-134486 | A | 5/1992 |
| JP | 9-331245 | A | 12/1997 |
| JP | 2004-253804 | A | 9/2004 |
| WO | 03/017247 | A1 | 2/2003 |

* cited by examiner

*Primary Examiner* — Quan-Zhen Wang
*Assistant Examiner* — Saifeldin Elnafia
(74) *Attorney, Agent, or Firm* — Lerner, David, Littenberg, Krumholz & Mentlik, LLP

(57) ABSTRACT

A light emitting diode (LED) driving apparatus includes a drive section for driving an LED to emit light, and a control section that controls a driving current supplied from the drive section to the LED. The control section implements luminous power control by controlling an ON/OFF ratio of the driving current if a target value of luminous power of the LED is smaller than a predetermined value. The control section implements luminous power control by controlling a level of the driving current if the target value is equal to or larger than the predetermined value.

6 Claims, 8 Drawing Sheets

LED DRIVING APPARATUS AND METHOD OF CONTROLLING LUMINOUS POWER

CROSS-REFERENCE TO RELATED APPLICATIONS

The present application claims priority from Japanese Patent Application Nos. JP 2004-296148 filed on Oct. 8, 2004 and JP 2005-227965 filed on Aug. 5, 2005, the disclosures of which are hereby incorporated by reference herein.

BACKGROUND OF THE INVENTION

The present invention relates to an LED driving apparatus and a method of controlling luminous power.

A display, such as a liquid crystal display, that is not a self-emitting display is provided with a backlight. As such a backlight, one employing cold-cathode tubes as its light source has been known for example. In addition, in recent years, backlights employing light emitting diodes (LEDs), which consume less power, have also been known.

As a method of controlling the luminous power of such a backlight including LEDs, two kinds of methods have been known. One is a current value control method for controlling the level of a driving current supplied to the LEDs. Another is to implement pulse width modulation (PWM) control with keeping a driving current level constant.

In the current value control, the level itself of a driving current continuously supplied to the LEDs is changed to thereby achieve aimed luminous power. In the PWM control, the ON/OFF ratio of a driving current per unit time is changed to thereby achieve desired luminous power.

An example of documents disclosing the related art is Japanese Patent Laid-open No. 4-134486.

It has been known that the luminous efficiency of an LED varies depending on the value of a driving current therefor.

This respect will be described with reference to FIGS. 7 to 9.

FIG. 7 illustrates a graph of the relationship between forward voltages and forward currents of a certain LED.

FIG. 8 illustrates a graph of the relationship between the forward currents and luminous power of the LED. Specifically, FIG. 7 shows the respective values of the forward voltages obtained when forward currents of certain values are applied to the LED. FIG. 8 shows the respective values of the luminous power obtained when the forward currents of the certain values are applied to the LED.

Luminous efficiency is obtained by dividing luminous power by input power. Therefore, the luminous efficiency of the LED is obtained through the following procedure: a certain forward current value in the graph of FIG. 7 is multiplied by the corresponding forward voltage value to obtain the input power; and the luminous power value in FIG. 8 corresponding to the forward current value is divided by the obtained input power.

FIG. 9 illustrates a graph of the relationship between luminous efficiency that can be obtained through the above procedure and the forward current values.

As the graph shows, in the LED, the luminous efficiency increases as the forward current value increases from 50 mA to 100 mA, and the luminous efficiency decreases as the forward current value increases above 100 mA. The maximum luminous efficiency is obtained near a current value of 100 mA.

As is apparent from this graph, LEDs have characteristics in that the luminous efficiency varies depending on the value of the forward current (driving current). Specifically, the luminous efficiency of an LED is apt to increase as the driving current value increases until a certain current level, while above this level, the luminous efficiency is apt to decrease as the current value increases.

Since the luminous efficiency of an LED varies depending on the driving current value, the following problems arise in an LED driving apparatus that controls the luminous efficiency of an LED with any of the above-described methods: current value control and PWM control.

In the current value control, if the target value of the luminous power to be controlled is identical to the value corresponding to the current value providing the highest luminous efficiency like that shown in FIG. 9, the LED can be driven with the highest luminous efficiency. However, the target value does not necessarily correspond with the value, and therefore there is a possibility that the LED is driven with a low luminous efficiency. with a low luminous efficiency.

As for the PWM control, ON/OFF of a current is controlled with keeping the value of the current constant. Therefore, the constant current value must be the value corresponding to the maximum luminous power value in the allowable range thereof.

The current value for the maximum luminous power in the allowable range also does not necessarily correspond with the above current value for the highest luminous efficiency. Accordingly, there is a possibility that the LED is driven with a low luminous efficiency also in the PWM control.

Driving an LED with a low luminous efficiency requires unnecessary extra power higher than originally needed input power, which leads to the increase of power consumption. In addition, if an LED is driven with a low luminous efficiency, the heating value of the LED, a driving circuit thereof, and a power supply unit is apt to increase, which causes a problem that measures against the heating preclude the miniaturization of the device, for example.

SUMMARY OF THE INVENTION

In consideration of the above problem, it is desirable to provide an LED driving apparatus that has the following configuration.

Specifically, the LED driving apparatus includes drive means for driving an LED to emit light, and control means that controls a driving current supplied from the drive means to the LED. The control means implements luminous power control by controlling an ON/OFF ratio of the driving current if a target value of luminous power of the LED is smaller than a predetermined value. The control means implements luminous power control by controlling a level of the driving current if the target value is equal to or larger than the predetermined value.

In addition, according to an embodiment of the present invention, a method of controlling luminous power has the following feature.

Specifically, as a method of controlling the luminous power of an LED, an ON/OFF ratio of a driving current is controlled if a target value of the luminous power of the LED is smaller than a predetermined value, and a level of the driving current is controlled if the target value is equal to or larger than the predetermined value.

According to an embodiment of the present invention, a light emitting diode (LED) driving apparatus includes a drive section for driving an LED to emit light, and a control section that controls a driving current supplied from the drive section to the LED. The control section implements luminous power control by controlling an ON/OFF ratio of the driving current if a target value of luminous power of the LED is smaller than a predetermined value. The control section implements luminous power control by controlling a level of the driving current if the target value is equal to or larger than the predetermined value.

According to an embodiment of the present invention, the method of controlling the driving of an LED is switched between the above-described current value control and the PWM control according to a target value of luminous power. Specifically, according to the above configurations, the control method can be switched to the PWM control if the target value is smaller than the luminous power value providing the highest luminous efficiency of an LED. If the target value is equal to or larger than the predetermined value, the control method can be switched to the driving current control.

If such luminous power control is possible, the PWM control can be implemented in which a driving current level is kept constant at the level providing the highest luminous efficiency of the LED when the target value is smaller than the predetermined value. Thus, the LED can be driven with the highest luminous efficiency.

In addition, if the target value is equal to or larger than the predetermined value, switching to the current value control can obtain desired luminous power with as little power as possible. If the PWM control is implemented even when the target value is equal to or larger than the predetermined value, the driving current level inevitably needs to be larger compared with the case of implementing the current value control. The larger current level results in the driving of an LED with a lower luminous efficiency as is apparent from the characteristic diagram of FIG. 9. Therefore, switching to the current value control allows an LED to be driven most efficiently.

As described above, according to an embodiment of the present invention, luminous power control is switched between the PWM control and the current value control depending on a target value of luminous power. Thus, an LED can be driven with the highest luminous efficiency possible.

In addition, this control method switching can minimize the power consumed to drive an LED, and further can minimize the heating value of an LED, a driving circuit thereof, and a power supply unit. Thus, the device can be miniaturized.

BRIEF DESCRIPTION OF THE DRAWINGS

These and other objects of the invention will be seen by reference to the description, taken in connection with the accompanying drawings, in which.

DETAILED DESCRIPTION

Best modes (embodiments hereinafter) for carrying out the invention will be described below.

Initially, one example of the configuration of a liquid crystal display equipped with a light emitting diode (LED) driving apparatus of an embodiment will be described referring to FIG. 1.

Figure 1:
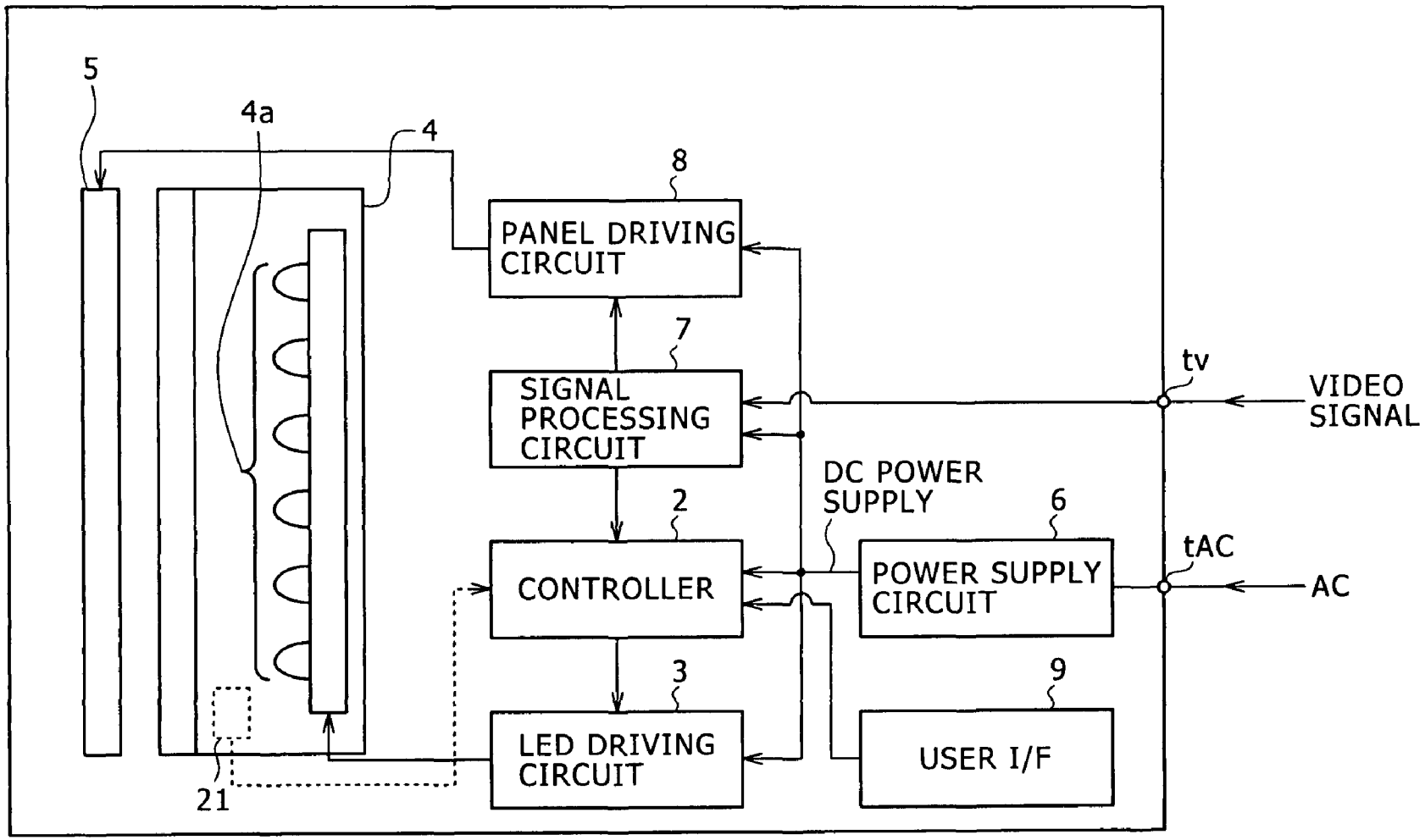
FIG. 1 is a block diagram illustrating an example of the configuration of a liquid crystal display provided with an LED driving apparatus according to an embodiment of the invention.

Referring to FIG. 1, AC power supply is input from an AC power supply input terminal tAC to the liquid crystal display.

A power supply circuit 6 is fed with the AC power supply from the AC power supply input terminal tAC to produce a DC voltage. The power supply circuit 6 then supplies the produced DC voltage as the illustrated DC power supply to a signal processing circuit 7, a panel driving circuit 8, a controller 2, and an LED driving circuit 3.

Furthermore, video signals are input from a video input terminal tv to the liquid crystal display. The video signals are supplied to the signal processing circuit 7. The signal processing circuit 7 implements required signal processing for the supplied video signal to thereby obtain a signal necessary for controlling the driving of a liquid crystal panel 5.

The signal processing circuit 7 supplies to the panel driving circuit 8 a signal necessary for controlling the driving of the panel. The panel driving circuit 8 drives the liquid crystal panel 5 based on the signal.

In addition, the signal processing circuit 7 extracts a luminance signal from the input video signal and supplies the luminance signal to the controller 2.

The controller 2 is, for example, a micro computer including a central processing unit (CPU), a read only memory (ROM), a random access memory (RAM) etc., and implements overall control of the liquid crystal display.

The controller 2 adjusts the luminous power of LEDs 4*a* provided in a backlight 4 according to information of an average picture level (APL) (average luminance) calculated based on the luminance signal supplied from the signal processing circuit 7. According to the luminous power control based on the information of an APL, when the APL is lower than a certain level for example, the luminous power of the backlight is decreased to a predetermined value (one-tenth, for example) to thereby achieve high contrast.

In addition to the adjustment based on an APL, the controller 2 adjusts the luminous power of the LEDs 4*a* in the backlight 4 also in response to the operation by a user via a user interface (I/F) 9.

The user I/F 9 comprehensively includes a command receiver that receives a command signal from an operating element provided on the outer surface of the case of the liquid crystal display, or a remote controller. For example, a user operates a knob operating element for brightness adjustment provided on the outer surface of the case, and thereby can input to the liquid crystal display an instruction as to the luminous power of the backlight 4. Alternatively, a user selects an item of brightness adjustment from a configuration menu displayed on the screen of the liquid crystal panel 5 to thereby carry out operational input according to an instruction via the screen. Thus, an instruction as to the luminous power of the backlight 4 can be input.

If an instruction is thus input by a user via the user I/F 9, the controller 2 controls the luminous power of the backlight 4 in response to the instruction input information.

Figure 2:
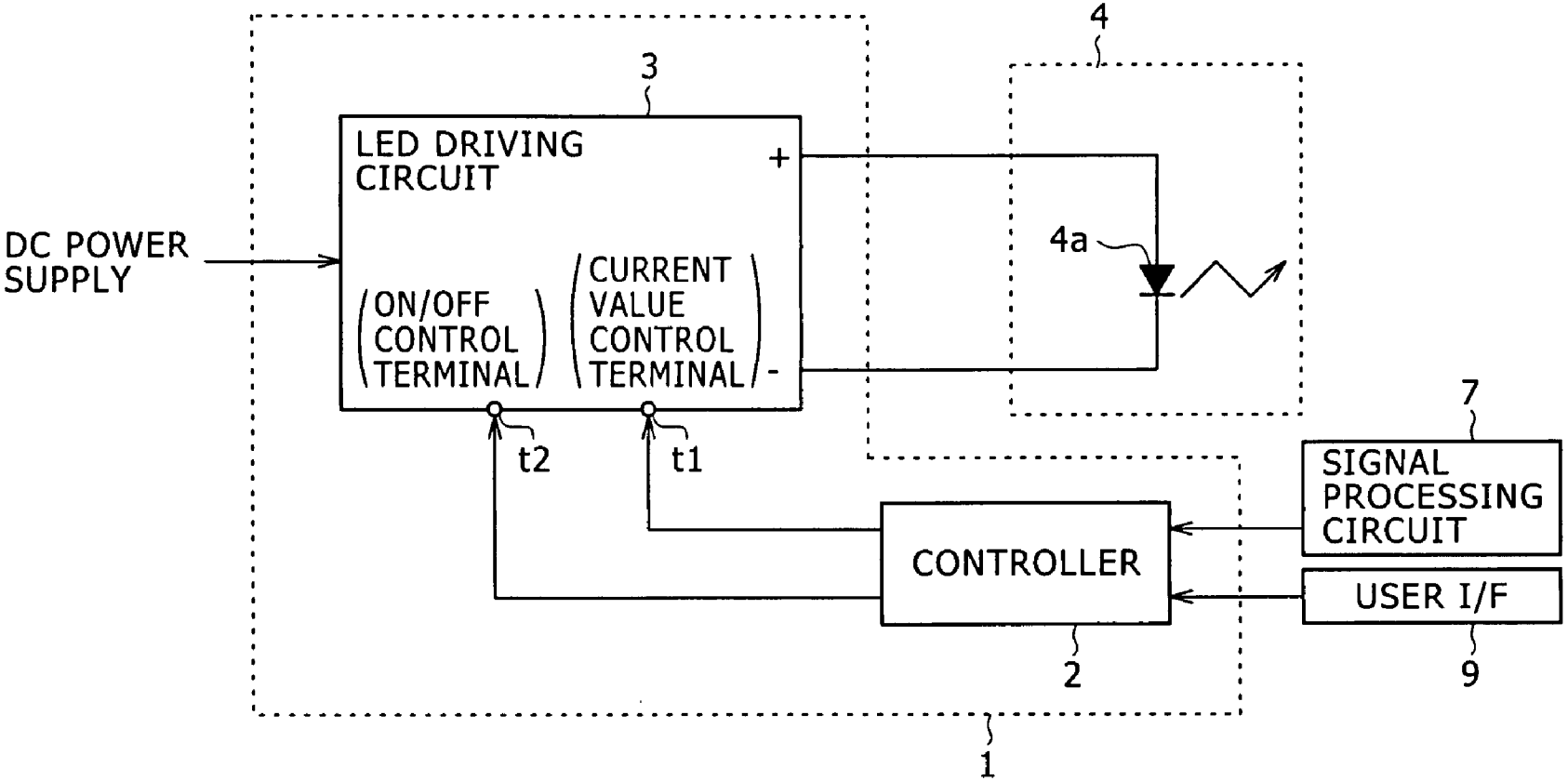
FIG. 2 is a block diagram illustrating the configuration of an LED driving apparatus according to a first embodiment of the invention.

FIG. 2 is a block diagram that picks up and illustrates, of the configuration shown in FIG. 1, part relating to control of the luminous power of the LED 4*a* in the backlight 4.

Referring to FIG. 2, the LED driving circuit 3 is fed with DC power supply from the power supply circuit 6 shown in FIG. 1, and supplies a driving current to the LED 4*a* in the backlight 4 based on the DC power supply.

The LED driving circuit 3 is provided with a current value control terminal t1 and an ON/OFF control terminal t2. The respective terminals receive a control signal from the controller 2 as shown in the drawing. With a configuration to be described later, the LED driving circuit 3 changes the level of a driving current supplied to the LEDs 4*a* in response to the control signal supplied to the current value control terminal t1. In addition, in response to the control signal supplied to the ON/OFF control terminal t2, the LED driving circuit 3 changes the ON/OFF timing of a driving current with keeping the level of the driving current constant.

Note that the controller 2 and the LED driving circuit 3 constitute the LED driving apparatus 1 as the first embodiment as shown also in FIG. 2.

The controller 2 sets the target value of the luminous power of the LED 4*a* according to APL information calculated based on a luminance signal from the signal processing circuit 7 shown also in FIG. 1, and according to an instruction input value if an instruction as to the brightness adjustment is input from the user I/F 9. The controller 2 then supplies a control signal to the current value control terminal t1 or the ON/OFF control terminal t2 of the LED driving circuit 3 so that the luminous power of the target value is obtained.

The controller 2 of the embodiment stores in advance information of the forward current value (driving current level) providing the highest luminous efficiency and the luminous power value (predetermined value) obtained from the forward current value as to the LED 4*a*.

The controller 2 switches between luminous power control attributed to supply of a control signal to the current value control terminal t1 (current value control) and luminous power control attributed to supply of a control signal to the ON/OFF control terminal t2 (PWM control) based on the result of comparison between the stored luminous power value as the predetermined value and the set target value. This switching will be described later in detail.

In addition, in the first embodiment, the ROM of the controller 2 stores, in correspondence with target values of luminous power, information of driving current values and the ON/OFF ratios of a driving current for obtaining the corresponding luminous power.

Specifically, if the controller 2 implements the current value control, the controller 2 obtains information of a driving current value based on the set target value and the stored correspondence information, and supplies the current value information to the current value control terminal t1 of the LED driving circuit 3 to thereby control luminous power. When the current value control is implemented, as a control signal applied to the ON/OFF control terminal t2, an ON control signal that turns on supply of a driving current is applied.

Furthermore, if the PWM control is implemented, the controller 2 obtains information of an ON/OFF ratio based on the set target value and the stored correspondence information, and supplies an ON/OFF control signal to the ON/OFF control terminal t2 based on the information to thereby control luminous power. When implementing the PWM control, such current value information is supplied to the current value control terminal t1 that the current value is kept constant at the value of the forward current providing the highest luminous efficiency of the LED 4*a*.

In this case, such ON/OFF ratio information for the PWM control is supplied that the ratio of length of the ON period to the total length of the ON and OFF periods equals the value obtained by dividing the target value of luminous power by the luminous power value as the predetermined value.

Figure 3:
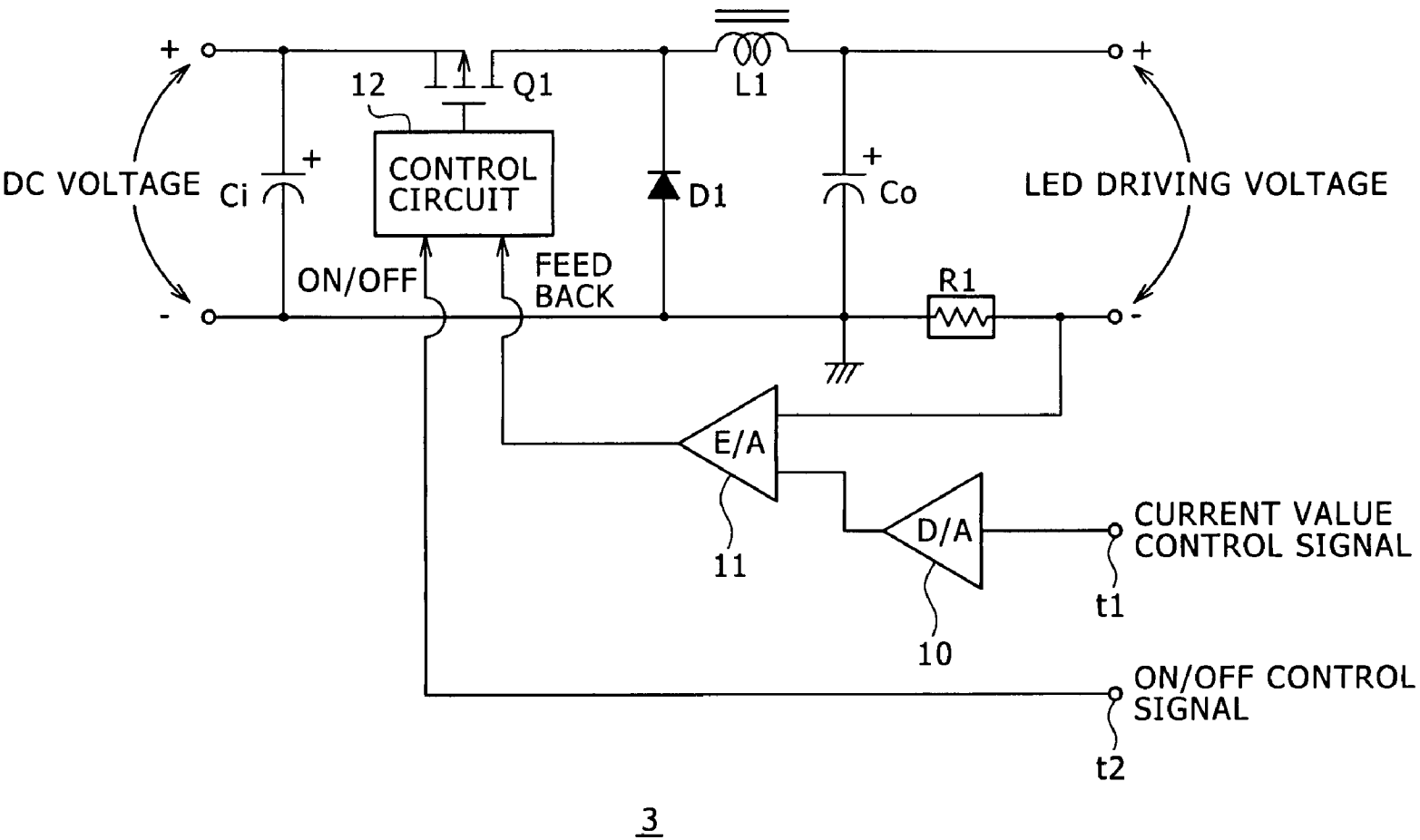
FIG. 3 is a circuit diagram illustrating the internal configuration of the LED driving circuit.

FIG. 3 illustrates the internal configuration of the LED driving circuit 3 shown in FIG. 2.

Since the DC power supply shown in FIG. 2 is supplied across a capacitor Ci, a DC voltage is stored across the capacitor Ci. A switching element Q1, a diode D1, and a choke coil L1 constitute a down converter employing the voltage across the capacitor Ci as operation power supply. The operation of the down converter produces an LED driving voltage of a DC voltage across a smoothing capacitor Co. Thus, a DC driving current is supplied to the LED 4*a* shown in FIG. 2.

As the switching element Q1, an MOS-FET is adopted.

The switching element Q1 is driven and controlled by a control circuit 12.

The control circuit 12 is supplied with an ON/OFF control signal from the ON/OFF control terminal t2 as shown in the drawing, and turns on and off of the switching element Q1 based on the ON/OFF control signal.

In addition, input to the control circuit 12 is a feedback signal from an error amplifier (E/A) 11.

A current detection resistor R1 incorporated in the output line of an LED driving voltage detects the level of a driving current supplied to the LED 4*a* and inputs the level to the error amplifier 11. In addition to the detected current level, input to the error amplifier 11 is a current value control signal that has been input via the current value control terminal t1 illustrated also in FIG. 2 and has been converted into an analog signal by a D/A converter 10. The error amplifier 11 outputs a signal according to the difference between the input driving current level and level of the current value control signal.

The control circuit 12 controls the operation of the switching element Q1 according to the output signal from the error amplifier 11, to thereby control so that the level of a driving current supplied to the LED 4*a* is kept constant at the value corresponding to the current value control signal supplied to the current value control terminal t1.

Here, as described above, the luminous efficiency of the LED changes depending on the level of a supplied driving current (forward current). Specifically, as shown in FIG. 9, the luminous efficiency is apt to increase as a forward current value increases until a certain forward current value, and above the value, the luminous efficiency is apt to decrease as a forward current value increases.

Since the luminous efficiency changes depending on the forward current value, the above-described current value control and PWM control involve a possibility that the LED 4*a* is driven with a low luminous efficiency.

Figure 9:
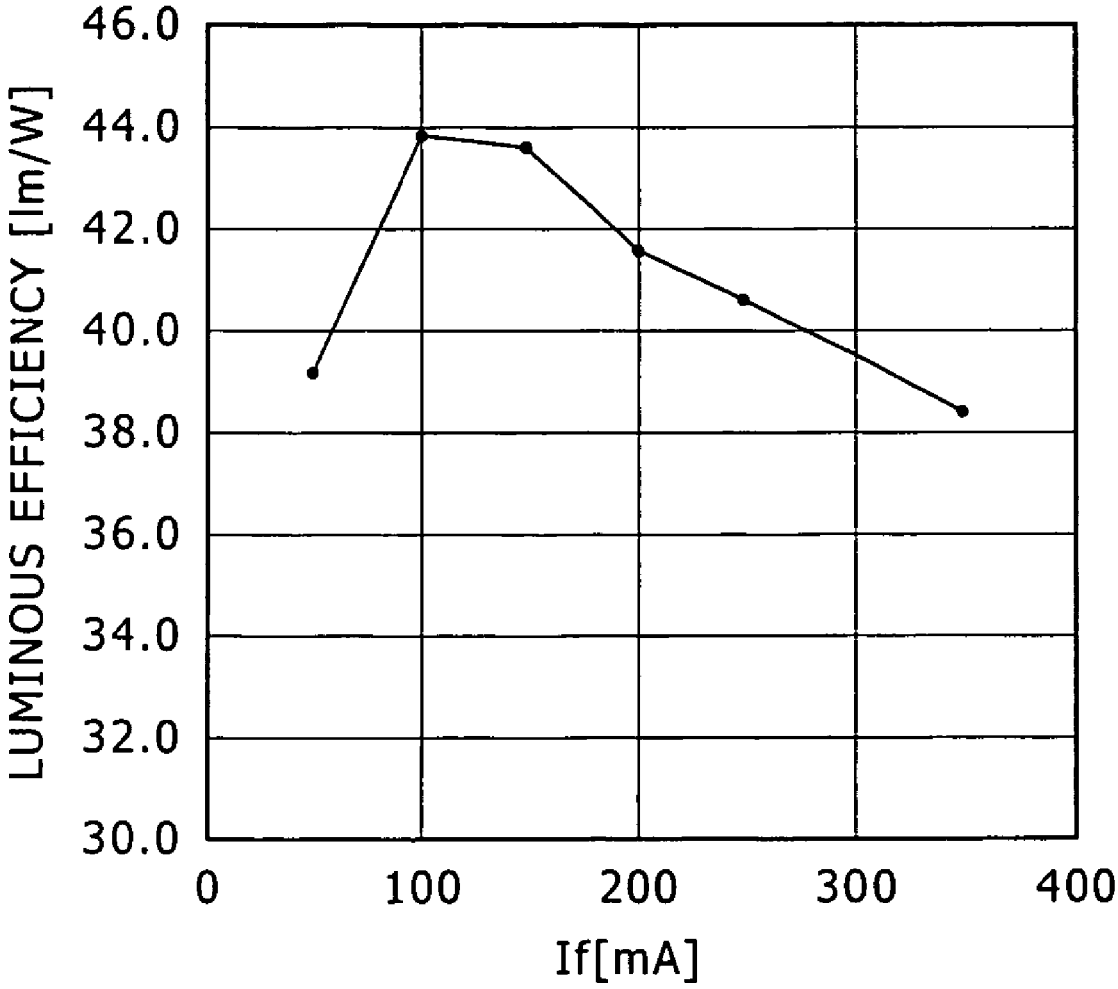
FIG. 9 is a diagram illustrating a graph of the relationship between the forward currents and luminous efficiency of the certain LED.

Therefore, in the present embodiment, the forward current value providing the highest luminous efficiency (the best current value) and the luminous power (predetermined value) obtained from the forward current value are obtained in advance referring to the result of an experiment, like that shown in the characteristic diagram of FIG. 9, as to the relationship between forward current values and luminous efficiency of the LED 4*a*. When the LED 4*a* is driven to emit light with luminous power smaller than the luminous power of the predetermined value, luminous power is controlled by the PWM control with keeping the driving current value at the best current value. When the LED 4*a* is driven to emit light with a luminous power value equal to or larger than the predetermined value, the current value control is implemented.

Thus, when the LED 4*a* is driven to emit light with luminous power smaller than the predetermined value, the LED 4*a* can be driven with the constant best current value invariably. Therefore, the LED 4*a* can be driven with the highest luminous efficiency.

In addition, also in the case of driving the LED 4*a* to emit light with at least the luminous power of the predetermined value, the LED 4*a* can be driven with as high luminous efficiency as possible. Specifically, if the PWM control is maintained even for a luminous power value equal to or larger than the predetermined value, the driving current level for the PWM control, which is constant, must inevitably be set higher than the level of a driving current employed when implementing the current value control for the luminous power value. The increase of the driving current level decreases the luminous power as is apparent from the characteristic of FIG. 9. Therefore, when driving the LED 4*a* to emit light with at least the luminous power of the predetermined value, the current value control allows the driving of the LED 4*a* with a higher luminous efficiency.

Thus, the luminous power control of the embodiment can drive the LED 4*a* with a condition providing as high luminous efficiency as possible invariably. Accordingly, power consumption due to the driving of the LED 4*a* can be minimized. In addition, if the LED 4*a* can be driven to emit light with a condition providing as high luminous efficiency as possible invariably, the heating value of the LED 4*a* itself, the LED driving circuit 3, and the power supply circuit 6 (refer to FIG. 1) that supplies DC power supply to the LED driving circuit 3 can be minimized. It therefore is prevented that the size of the device is increased to address the heating.

Figure 4:
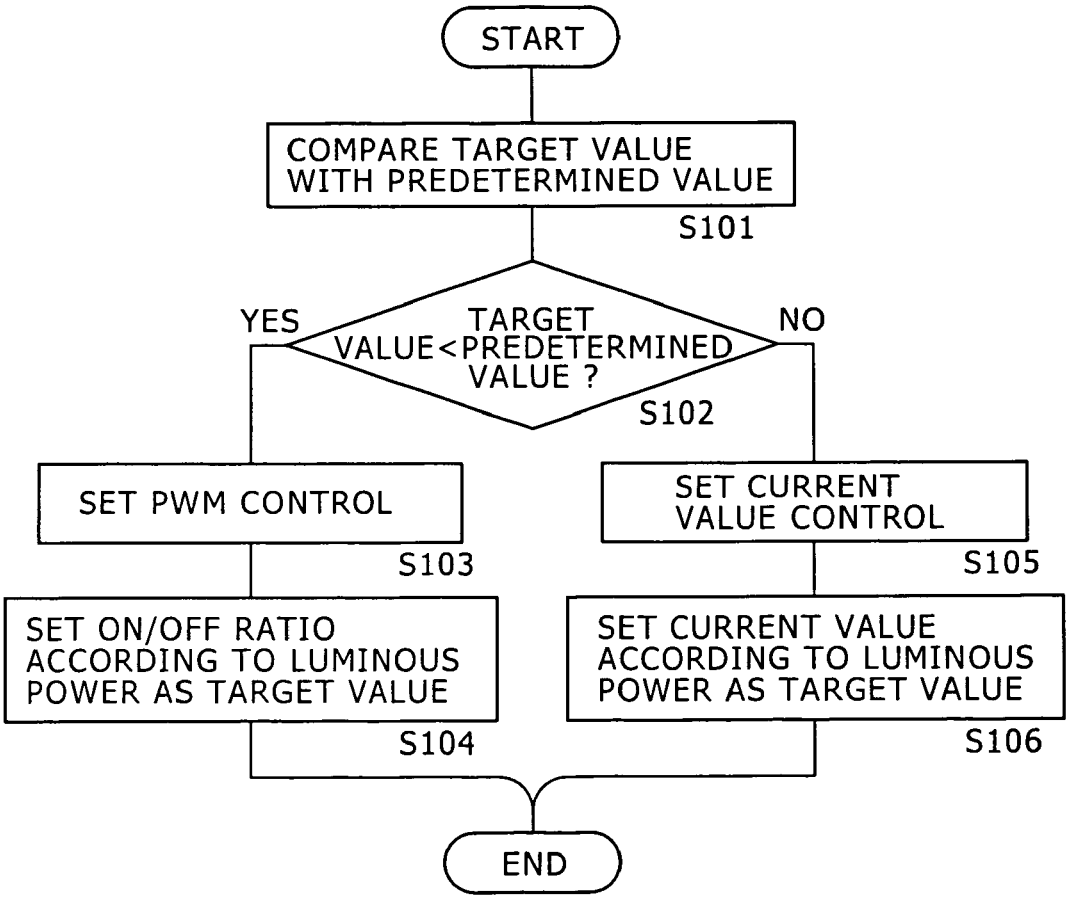
FIG. 4 is a flow chart illustrating processing operation for achieving the operation of the first embodiment.

FIG. 4 is a flow chart illustrating processing operation for achieving the operation of the first embodiment.

The processing operation shown in FIG. 4 is executed based on a program stored in an ROM or the like incorporated in the controller 2, for example.

Referring to FIG. 4, in a step S101, processing of comparing a set target value and the above-described predetermined value is executed.

Subsequently, in a step S102, processing of determining whether or not the target value is smaller than the predetermined value is executed based on the result of the comparison processing of the step S101.

If the positive determination that the target value is smaller than the predetermined value is obtained in the step S102, the processing sequence moves to a step S103, in which processing of setting the PWM control is executed. Specifically, in order to implement, as the PWM control, the ON/OFF control of a driving current with keeping the driving current value constant at the above-described best current value, initially a current value control signal for indicating the best current value is supplied to the current value control terminal t1 of the LED driving circuit 3.

Sequentially, in a step S104, the ON/OFF ratio according to the luminous power as the target value is set. Specifically, information of the ON/OFF ratio associated with the input target value is retrieved from correspondence information stored in an ROM or the like. An ON/OFF control signal based on the ratio information is then supplied to the ON/OFF control terminal t2 to thereby control luminous power by the PWM control.

Alternatively, if the negative determination that the target value is not smaller than the predetermined value (the target value is equal to or larger than the predetermined value) is obtained in the step S102, processing of setting the current value control is executed in a step S105. Specifically, in order to implement the current value control and therefore continuously supply a driving current, an ON control signal is initially supplied to the ON/OFF control terminal t2.

Sequentially, in a step S106, the current value according to the luminous power as the target value is set. Specifically, information of the current value associated with the input target value is retrieved from the correspondence information. A current value control signal based on the current value information is then supplied to the current value control terminal t1 to thereby control luminous power by the current value control.

Through the above processing operation, luminous power control can be implemented by the PWM control when aimed luminous power is smaller than the predetermined value, and can be implemented by the current value control when aimed luminous power is equal to or larger than the predetermined value.

Figure 5:
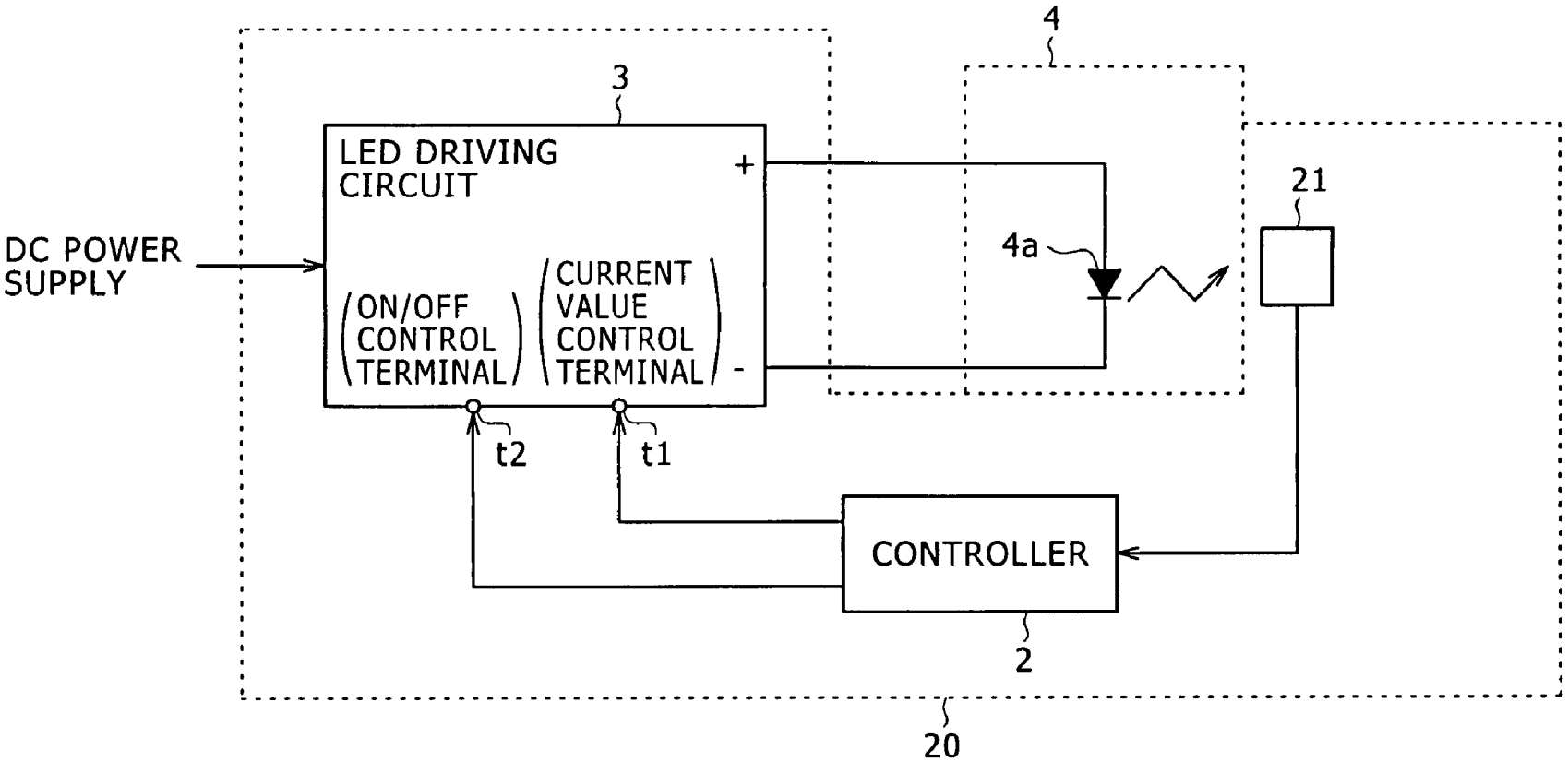
FIG. 5 is a block diagram illustrating the configuration of an LED driving apparatus according to a second embodiment of the invention.

FIG. 5 illustrates the configuration of an LED driving apparatus 20 as a second embodiment of the invention.

The LED driving apparatus 20 of the second embodiment also implements switching of the luminous power control methods, implemented in the first embodiment. Furthermore, the LED driving apparatus 20 includes a luminous power sensor 21 in addition to the configuration of the LED driving apparatus 1 shown in FIG. 2. The luminous power sensor 21 is provided at a certain place in the backlight 4 so as to detect the luminous power of the LED 4*a* (the luminous power sensor 21 is represented with a dashed line in FIG. 1).

Information of the luminous power detected by the luminous power sensor 21 is input to the controller 2.

The controller 2 controls the luminous power of the LED 4*a* based on the luminous power value detected and input by the luminous power sensor 21 as well as based on the target value of luminous power set according to a brightness signal from the signal processing circuit 7 and an instruction input from the user I/F 9 as described above.

Specifically, the luminous power is controlled by changing a current value control signal supplied to the current value control terminal t1 or an ON/OFF control signal supplied to the ON/OFF control terminal t2 so that the value of the luminous power detected and input by the luminous power sensor 21 equals the target value.

Since luminous power is thus controlled based on the actually measured value of luminous power of the LED 4*a*, the luminous power as the target value can be achieved more accurately even if there is variation in luminous power among the LEDs 4*a* for the same forward current value, for example.

This luminous power control can prevent variation in luminous power of the LEDs 4*a* among devices effectively.

Figure 6:
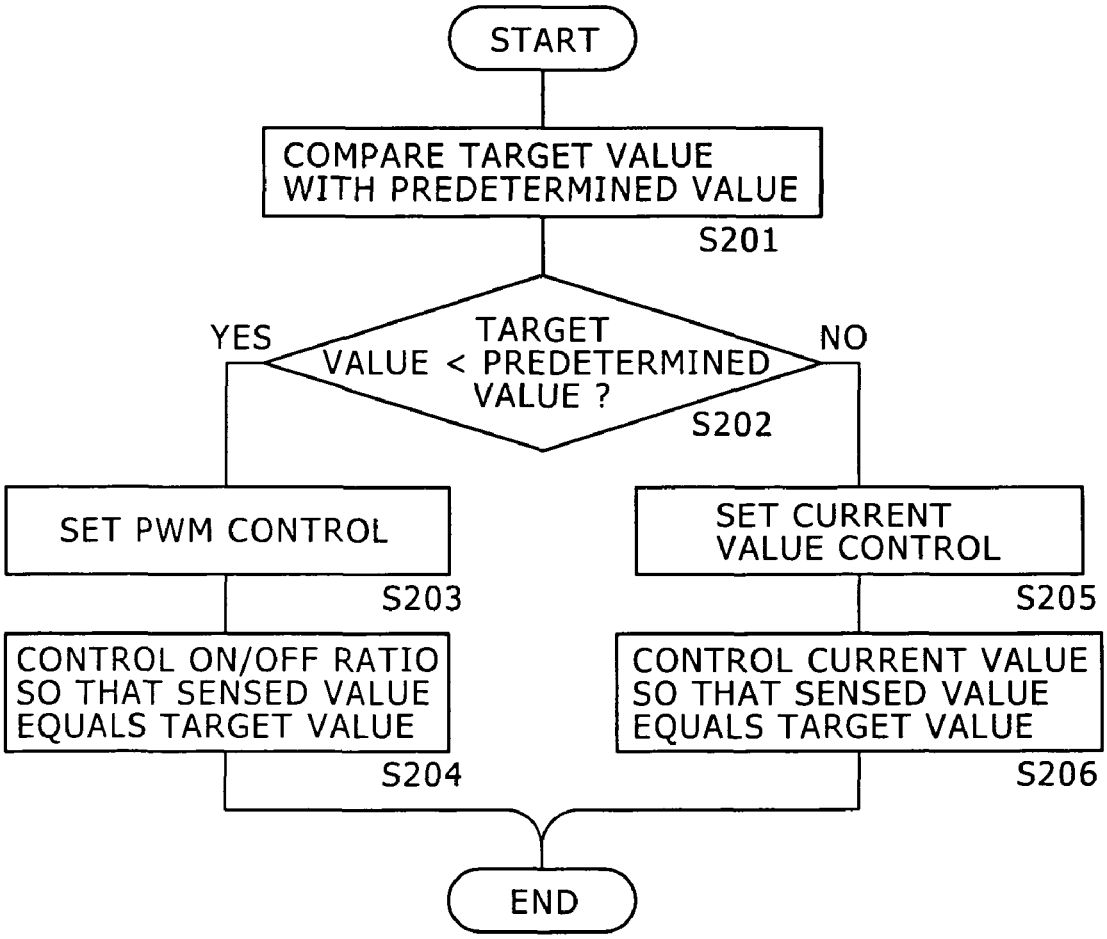
FIG. 6 is a flow chart illustrating processing operation for achieving the operation of the second embodiment.
Figure 7:
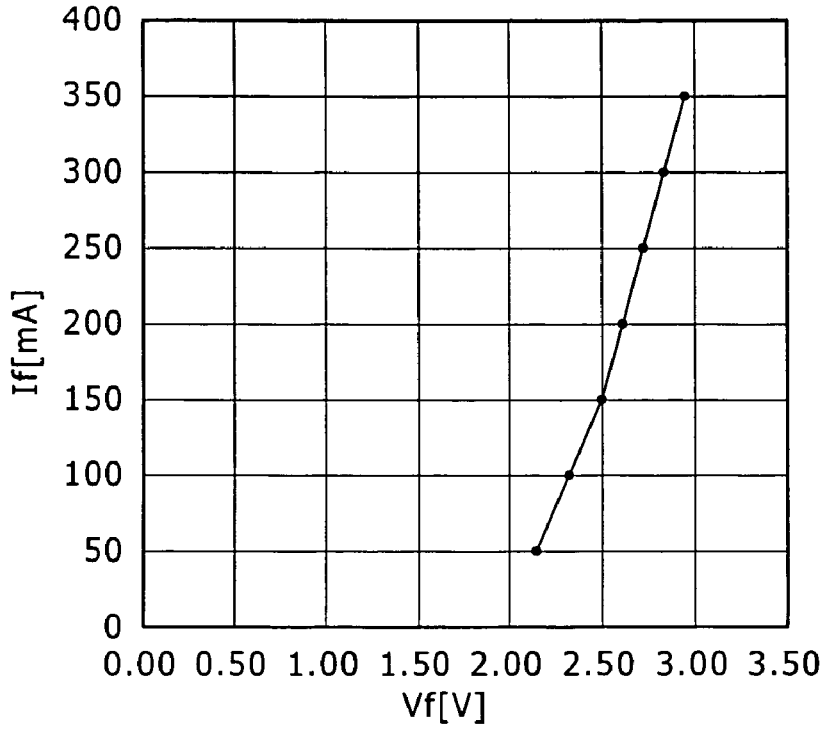
FIG. 7 is a diagram illustrating a graph of the relationship between forward voltages and forward currents of a certain LED.
Figure 8:
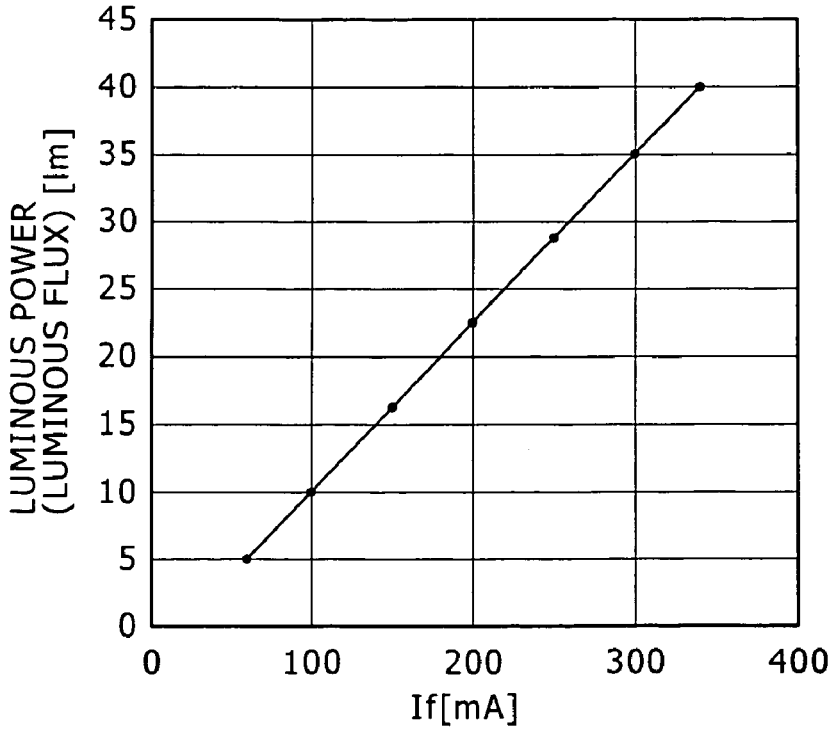
FIG. 8 is a diagram illustrating a graph of the relationship between the forward currents and luminous power of the certain LED.

FIG. 6 is a flow chart illustrating processing operation for achieving the operation of the LED driving apparatus 20 of the second embodiment.

The processing operation shown in FIG. 6 is also executed based on a program stored in an ROM or the like incorporated in the controller 2.

In steps S201 and S202, as with the processing of the steps S1.01 and S102 shown in FIG. 4, processing of comparing a target value with the predetermined value and processing of determining from the compassion result whether or not the target value is smaller than the predetermined value, are implemented.

Subsequently, if the target value is smaller than the predetermined value and thus the positive determination is obtained, processing of setting the PWM control as processing of a step S203 is executed as with the step S103. Alternatively, if the negative determination that the target value is not smaller than the predetermined value is obtained, processing of setting the current value control is executed in a step S205 as with the step S105.

In this processing operation, in a step S204 after the PWM control has been set, processing of controlling the ON/OFF ratio so that the sensed value equals the target value is executed. Specifically, the ratio of the ON/OFF control signal supplied to the ON/OFF control terminal t2 of the LED driving circuit 3 is controlled so that the set target value equals the luminous power value from the luminous power sensor 21.

Furthermore, in a step S206 after the current value control has been set, processing of controlling the current value so that the sensed value equals the target value is executed. Specifically, the current value control signal supplied to the current value control terminal t1 of the LED driving circuit 3 is controlled so that the set target value equals the luminous power value from the luminous power sensor 21.

Through the above processing operation, the luminous power can be controlled more accurately based on the actually measured value while switching between the PWM control and current value control as the embodiment is implemented.

It should be noted that the invention is not limited to the above-described configurations of the embodiments.

For example, LEDs in a backlight of a liquid crystal display are driven to emit light in the embodiments. However, the invention can widely be applied to luminous power control of other LEDs.

In addition, the embodiments have the configurations for driving one LED to emit light for convenience of explanation. However, it is obvious that the similar luminous power control for plural LEDs can achieve the similar advantages.

Furthermore, the embodiments set a target value of luminous power according to APL information based on a brightness signal extracted from a video signal and operation by a user. However, factors for setting a target value of luminous power are not limited to these factors. The target value may be set based on other factors.

While preferred embodiments of the invention have been described using specific terms, such description is for illustrative purposes only, and it is to be understood that changes and variations may be made without departing from the spirit or scope of the following claims.

The invention claimed is:

1. A light emitting diode (LED) driving apparatus, comprising:

drive means for driving an LED to emit light; and control means that controls a driving current supplied from the drive means to the LED, in which the control means determines whether a target value of luminous power of the LED is smaller than a predetermined value, and when a determination result therefrom indicates that the target value is smaller than the predetermined value the control means implements luminous power control by controlling an ON/OFF ratio of the driving current, and when the determination result therefrom indicates that the target value is equal to or larger than the predetermined value the control means implements luminous power control by controlling a level of the driving current, when the control means implements luminous power control by controlling the ON/OFF ratio of the driving current, a ratio of a length of an ON period to a total length of the ON period and an OFF period equals a value obtained by dividing the target value by the predetermined value, in which luminous efficiency of the LED is obtained by dividing the luminous power by input power, and in which the predetermined value represents a luminous power value obtained from a driving current value having a highest value of the luminous efficiency of the LED, such that when the determination result indicates that the target value is smaller than the luminous power value obtained from the driving current value having the highest value of the luminous efficiency of the LED the control means implements the luminous power control by controlling the ON/OFF ratio of the driving current, and when the determination result indicates that the target value is equal to or larger than the luminous power value obtained from the driving current value having the highest value of the luminous efficiency of the LED the control means implements the luminous power control by controlling the level of the driving current, in which in the luminous power control implemented by controlling the ON/OFF ratio of the driving current, the level of the driving current is kept constant at the driving current value that provides the highest luminous efficiency of the LED.

2. The LED driving apparatus according to claim 1, wherein the control means stores correspondence information relating to the target value and the ON/OFF ratio, and relating to the target value and the driving current value, the control means implementing the luminous power control by setting the ON/OFF ratio or the driving current value associated with the target value in the correspondence information.

3. The LED driving apparatus according to claim 1, further comprising:

luminous power detection means that detects luminous power of the LED, wherein the control means implements the luminous power control by controlling the ON/OFF ratio or the driving current value so that a value of the luminous power detected and input by the luminous power detection means equals the target value.

4. A method of controlling the luminous power of an LED, the method comprising:

determining whether a target value of luminous power of the LED is smaller than a predetermined value;

controlling an ON/OFF ratio of a driving current if the target value is determined to be smaller than the predetermined value; and controlling a level of the driving current if the target value is determined to be equal to or larger than the predetermined value, when the ON/OFF ratio of the driving current is controlled, a ratio of a length of an ON period to a total length of the ON period and an OFF period equals a value obtained by dividing the target value by the predetermined value, in which luminous efficiency of the LED is obtained by dividing the luminous power by input power, and in which the predetermined value represents a luminous power value obtained from a driving current value having a highest value of the luminous efficiency of the LED, such that when the target value is determined to be smaller than the luminous power value obtained from the driving current value having the highest value of the luminous efficiency of the LED the ON/OFF ratio of the driving current is controlled, and when the target value is determined to be equal to or larger than the luminous power value obtained from the driving current value having the highest value of the luminous efficiency of the LED the level of the driving current is controlled, in which, when the ON/OFF ratio of the driving current is controlled, the level of the driving current is kept constant at the driving current value that provides the highest luminous efficiency of the LED.

5. A light emitting diode (LED) driving apparatus, comprising:

a drive section for driving an LED to emit light; and a control section that controls a driving current supplied from the drive section to the LED, in which the control section determines whether a target value of luminous power of the LED is smaller than a predetermined value, and when a determination result therefrom indicates that the target value is smaller than the predetermined value the control section implements luminous power control by controlling an ON/OFF ratio of the driving current, and when the determination result therefrom indicates that the target value is equal to or larger than the predetermined value the control section implements luminous power control by controlling a level of the driving current, when the control section implements luminous power control by controlling the ON/OFF ratio of the driving current, a ratio of a length of an ON period to a total length of the ON period and an OFF period equals a value obtained by dividing the target value by the predetermined value, in which luminous efficiency of the LED is obtained by dividing the luminous power by input power, and in which the predetermined value represents a luminous power value obtained from a driving current value having a highest value of the luminous efficiency of the LED, such that when the determination result indicates that the target value is smaller than the luminous power value obtained from the driving current value having the highest value of the luminous efficiency of the LED the control section implements the luminous power control by controlling the ON/OFF ratio of the driving current, and when the determination result indicates that the target value is equal to or larger than the luminous power value obtained from the driving current value having the highest value of the luminous efficiency of the LED control section implements the luminous power control by controlling the level of the driving current, in which in the luminous power control implemented by controlling the ON/OFF ratio of the driving current, the level of the driving current is kept constant at driving current value that provides the highest luminous efficiency of the LED.

6. Liquid crystal display apparatus, comprising:

a liquid crystal display panel;

a panel drive section for driving the liquid crystal display panel based on an image input signal;

a light emitting diode (LED) as a light source for the liquid crystal display panel;

a drive section for driving the LED to emit light; and a control section that controls a driving current supplied from the drive section to the LED, in which the control means determines whether a target value of luminous power of the LED is smaller than a predetermined value, and when a determination result therefrom indicates that the target value is smaller than the predetermined value the control section implements luminous power control by controlling an ON/OFF ratio of the driving current, and when the determination result therefrom indicates that the target value is equal to or larger than the predetermined value the control section implements luminous power control by controlling a level of the driving current, when the control section implements luminous power control by controlling the ON/OFF ratio of the driving current, a ratio of a length of an ON period to a total length of the ON period and an OFF period equals a value obtained by dividing the target value by the predetermined value, in which luminous efficiency of the LED is obtained by dividing the luminous power by input power, and in which the predetermined value represents a luminous power value obtained from a driving current value having a highest value of the luminous efficiency of the LED, such that when the determination result indicates that the target value is smaller than the luminous power value obtained from the driving current value having the highest value of the luminous efficiency of the LED the control section implements the luminous power control by controlling the ON/OFF ratio of the driving current, and when the determination result indicates that the target value is equal to or larger than the luminous power value obtained from the driving current value having the highest value of the luminous efficiency of the LED control section implements the luminous power control by controlling the level of the driving current, in which in the luminous power control implemented by controlling the ON/OFF ratio of the driving current, the level of the driving current is kept constant at the driving current value that provides the highest luminous efficiency of the LED.

* * * * *